US010246810B2

(12) United States Patent
Leisl, III et al.

(10) Patent No.: US 10,246,810 B2
(45) Date of Patent: Apr. 2, 2019

(54) WASHING MACHINE APPLIANCE AND BACKSPLASH ASSEMBLY

(71) Applicant: General Electric Company, Schenectady, NY (US)

(72) Inventors: Donald James Leisl, III, Louisville, KY (US); Craig Robert Vitan, Louisville, KY (US); Sripad Kulkarni, Hyderabad (IN)

(73) Assignee: HAIER US APPLIANCES SOLUTIONS, INC., Wilmington, DE (US)

( * ) Notice: Subject to any disclaimer, the term of this patent is extended or adjusted under 35 U.S.C. 154(b) by 388 days.

(21) Appl. No.: 15/137,065

(22) Filed: Apr. 25, 2016

(65) Prior Publication Data

US 2017/0306548 A1 Oct. 26, 2017

(51) Int. Cl.
*D06F 39/00* (2006.01)
*D06F 39/12* (2006.01)

(52) U.S. Cl.
CPC ..... *D06F 39/005* (2013.01); *D06F 39/12* (2013.01)

(58) Field of Classification Search
CPC ..... D06F 39/005; D06F 39/12
USPC ..... 68/12.23
See application file for complete search history.

(56) References Cited

U.S. PATENT DOCUMENTS 4,798,424 A 1/1989 Coates et al.
6,371,583 B1 * 4/2002 Visin ..... D06F 39/12 312/228
2004/0154909 A1 8/2004 Kim et al.
2015/0043135 A1 2/2015 Bas

* cited by examiner

*Primary Examiner* — Spencer E Bell
*Assistant Examiner* — Tinsae B Ayalew
(74) *Attorney, Agent, or Firm* — Dority & Manning, P.A.

(57) ABSTRACT

A washing machine is provided that may include a cabinet, a basket, and a backsplash. The cabinet may define an opening and include a backsplash bracket having a predefined footprint. The backsplash bracket may include one or more support decks, each having a planar top surface and a bottom surface. The backsplash bracket may define a first aperture extending through one support deck between a corresponding planar top surface and a corresponding bottom surface. The backsplash bracket may also define a second aperture extending through a support deck between a corresponding planar top surface and a corresponding bottom surface. The basket may be mounted within the cabinet and define a wash chamber beneath the opening to receive one or more clothing articles to be washed. The backsplash may be positioned over the predefined footprint and include a first and second engagement hook.

19 Claims, 5 Drawing Sheets

WASHING MACHINE APPLIANCE AND BACKSPLASH ASSEMBLY

FIELD OF THE INVENTION

The present subject matter relates generally to washing machine appliances, and more particularly to backsplash assemblies for washing machine appliances.

BACKGROUND OF THE INVENTION

Washing machine appliances generally include a cabinet having a tub for containing wash fluid, e.g., water and detergent, bleach, and/or other fluid additives. A basket is rotatably mounted within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

A backsplash assembly is often provided to support one or more components of a user interface. For instance, a display and/or one or more input selectors may be provided on the backsplash. Such components may display information about the appliance or allow certain operations or wash cycles to be selected by a user. Often, backsplash assemblies are permanently fixed to the cabinet during manufacture of the appliance. However, routine maintenance or repair may require removing the backsplash and/or user interface. Significant amounts of time and energy may be required to perform any repairs or maintenance operations.

Although some existing systems provide removable backsplash and/user interface assemblies, a user will often be required to access a back portion of the appliance in order to remove the backsplash and/or user interface assemblies. This can become especially difficult if the appliance is installed against a wall, or is otherwise positioned such that a rear portion of the appliance is blocked. As a result, even routine maintenance operations may become difficult.

Moreover, assembly of existing systems requires high degrees of precision. Structural integrity and consumer preferences generally demand that any gaps between assembled components be virtually nonexistent or unnoticeable. These attributes are difficult to achieve, however, when the backsplash assembly is formed as a separate component. Even mild warping of metal or plastic components can result in an undesirable assembled appearance.

Accordingly, an appliance having an improved backsplash assembly would be beneficial. More particularly, an appliance having a backsplash assembly that is easily assembled and removable from a front portion of the appliance would be especially useful.

BRIEF DESCRIPTION OF THE INVENTION

Aspects and advantages of the invention will be set forth in part in the following description, or may be obvious from the description, or may be learned through practice of the invention.

In one aspect of the present disclosure a washing machine is provided that defines a lateral direction, a transverse direction, and a vertical direction that are mutually orthogonal. The washing machine may include a cabinet, a basket, and a backsplash. The cabinet may define an opening and include a backsplash bracket. The backsplash bracket may have a predefined footprint. The backsplash bracket may include a first support deck and a second support deck. The first support deck may have a planar top surface. The second support deck may have a planar top surface that is positioned beneath the planar top surface of the first support deck along the vertical direction. The basket may be mounted within the cabinet and define a wash chamber beneath the opening to receive one or more clothing articles to be washed. The backsplash may be positioned over the predefined footprint. The backsplash may include a first engagement hook disposed on the first support deck and a second engagement hook disposed on the second support deck such that the first and second engagement hooks mount the backsplash to the backsplash bracket.

In another aspect of the present disclosure a washing machine is provided that defines a lateral direction, a transverse direction, and a vertical direction that are mutually orthogonal. The washing machine may include a cabinet, a basket, and a backsplash. The cabinet may define an opening and include a backsplash bracket having a predefined footprint. The backsplash bracket may include one or more support decks. Each support deck may have a planar top surface and a bottom surface. The backsplash bracket may define a first aperture extending through one of the one or more support decks between a corresponding planar top surface and a corresponding bottom surface. The backsplash bracket may also define a second aperture extending through one of the one or more support decks between a corresponding planar top surface and a corresponding bottom surface. The basket may be mounted within the cabinet and define a wash chamber beneath the opening to receive one or more clothing articles to be washed. The backsplash may be positioned over the predefined footprint. The backsplash may include a first engagement hook and a second engagement hook. The first engagement hook may be disposed in slidable engagement across the corresponding bottom surface of the first aperture. The second engagement hook may be disposed in slidable engagement across the corresponding bottom surface of the second aperture such that the first and second engagement hooks mount the backsplash to the backsplash bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
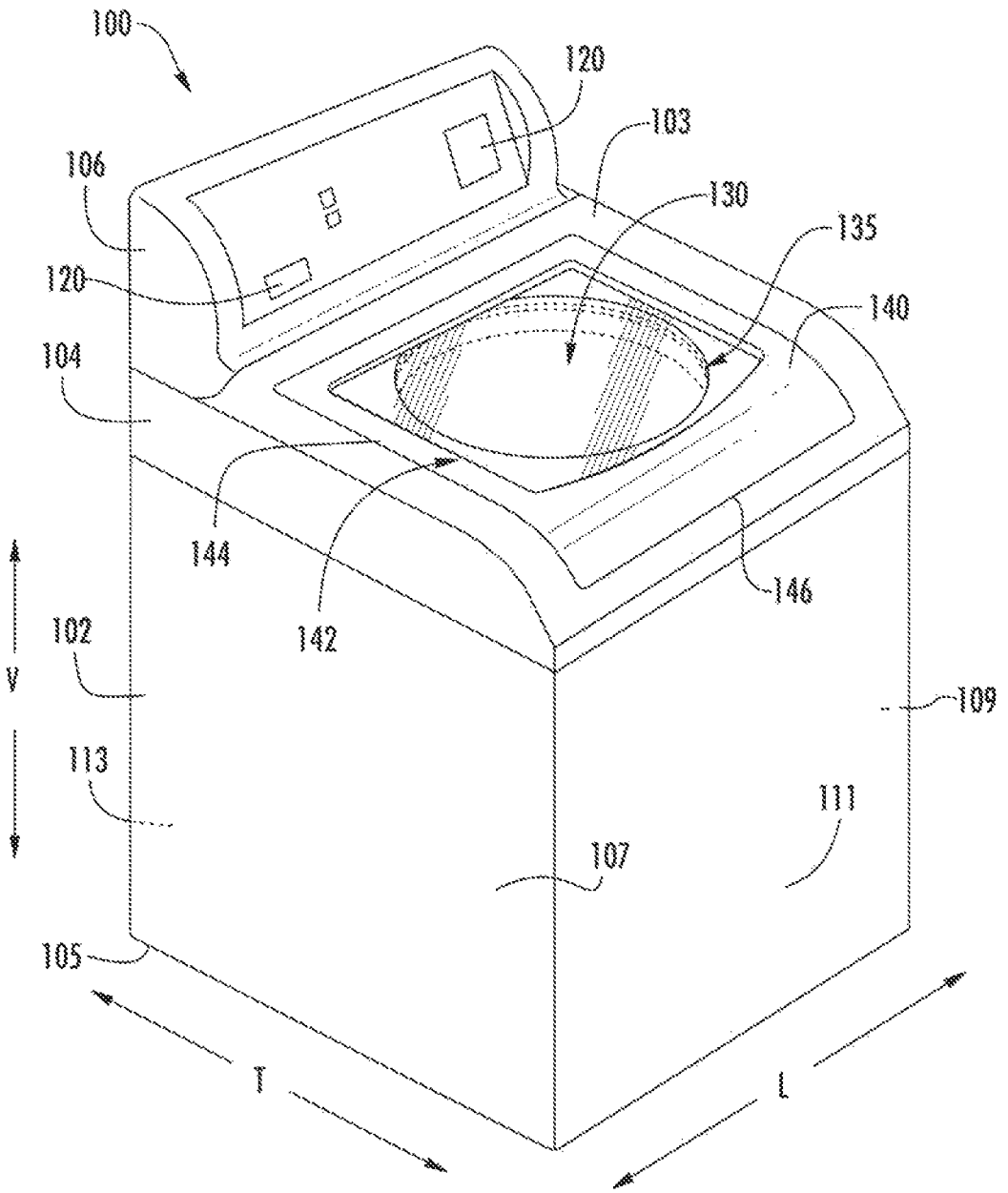
FIG. 1 provides a perspective view of a washing machine appliance according to an exemplary embodiment of the present disclosure.
Figure 2:
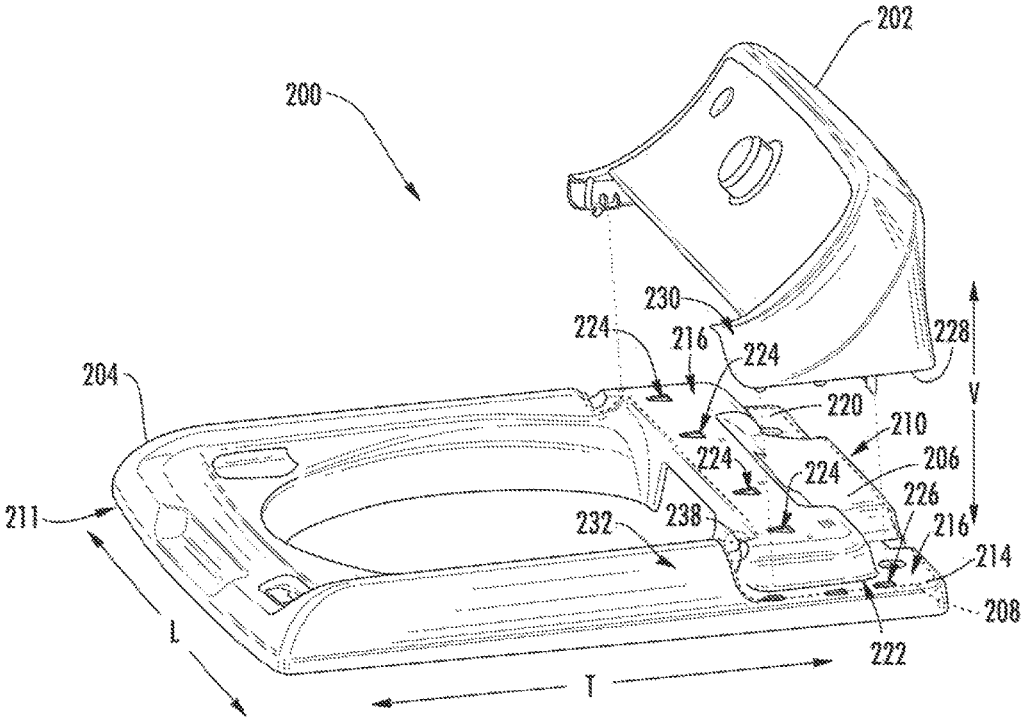
FIG. 2 provides an exploded perspective view of a backsplash assembly in accordance with an exemplary embodiment of the present disclosure.
Figure 3:
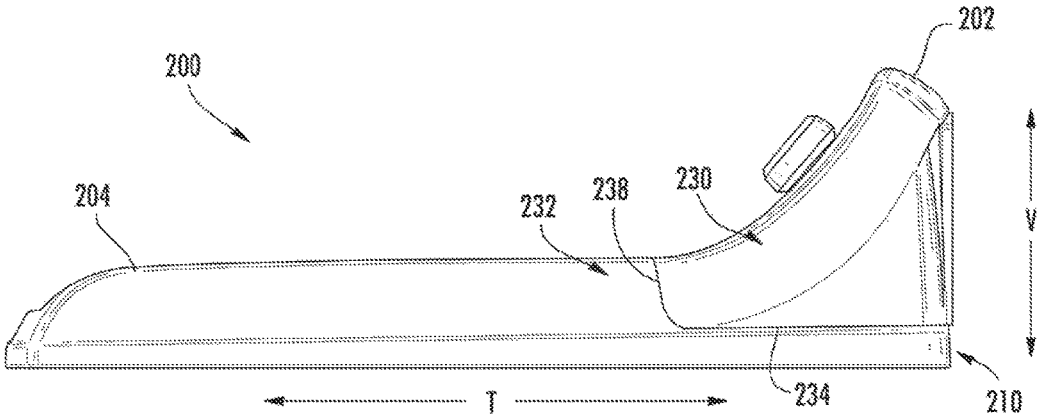
FIG. 3 provides an assembled side view of the exemplary backsplash assembly of FIG. 2.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter provides a washing machine appliance that includes a backsplash that can easily installed or removed from an opposite side of the appliance. For instance, the backsplash may be configured such that, if the backsplash is positioned at a rear portion of the appliance, the backsplash may be removed from the front portion by first sliding the backsplash rearward, then lifting the backsplash vertically.

FIG. 1 illustrates an exemplary embodiment of a vertical axis washing machine appliance 100. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well.

As may be seen in FIG. 1, washing machine appliance 100 has a cabinet 102 that defines a vertical direction V, a lateral direction L, and a transverse direction T. The vertical direction V, lateral direction L, and transverse direction T are all mutually perpendicular and form an orthogonal direction system. Generally, cabinet 102 extends between a top portion 103 and a bottom portion 105 along the vertical direction V. Cabinet 102 also extends between a first side portion 107 and a second side portion 109, e.g., along the lateral direction L, and a front portion 111 and a rear portion 113, e.g., along the transverse direction T.

Cabinet 102 of washing machine appliance 100 has a top cover 104 positioned at or adjacent top portion 103 of cabinet 102. Top cover 104 defines an opening 135 that permits user access to wash chamber 130 of wash basket 120. Door 140 is pivotally attached to top cover 104. However, alternatively, door 140 may be mounted to cabinet 102 or another suitable support. Door 140 selectively rotates a closed position and an open position. In the closed position, door 140 inhibits access to wash chamber 130. Conversely, in the open position, a user can access wash chamber 130. Door 140 also includes a handle 146 that, e.g., a user may pull and/or lift when opening and closing door 140.

Door 140 includes a pivotable frame 144 that defines an opening 135 above the wash chamber 130. A discrete panel 142 extends across the opening 135 such that panel 142 is bounded by a portion of pivotable frame 144 and restricts access through door 140. In some embodiments, panel 142 is configured as a window. For instance, panel 140 may be embodied as a transparent plastic or glass pane. In such embodiments, panel 142 may permit viewing of wash chamber 130 when door 140 is in the closed position, e.g., during operation of washing machine appliance 100.

A backsplash 106 extends from cover 104. A variety of appliance control input selectors 120 are coupled to backsplash 106, e.g., to control operation of the appliance. Input selectors can be of a touch type such as touchpad or may include more traditional knobs and dials. Regardless, input selectors 120 provide an interface whereby the user may operate the machine and select various operation features of the appliance. A display may also be provided on backsplash 106 for notifying the user of various aspect of the machine's operation including e.g., the mode of operation, water temperature selected, and other relevant information.

Washing machine 100 is controlled by a processing device or other controller, such as a microprocessor (not shown), according to user preference via manipulation of control input selectors 120 mounted on backsplash 106. As used herein, processing device may refer to one or more microprocessors or semiconductors devices and is not restricted necessarily to a single element. The processing device can be programmed to operate washing machine 100 according to features desired by the consumer.

Turning to FIGS. 2 through 9, an exemplary backsplash assembly 200 is illustrated. As shown, a selectively removable backsplash 202 is provided on a preformed top cover 204. It is understood that the backsplash 202 and top cover 204 could be embodied as backsplash 106 and top cover 104 illustrated in FIG. 1.

Included on top cover 204 is a backsplash bracket 206 having a predefined footprint 208. Generally, footprint 208 provides the area over which backsplash 202 may be positioned and mounted. In turn, backsplash bracket 206 is formed at a rear portion 210 of cover 204, i.e., opposite a front portion 211 in the transverse direction T. Backsplash bracket 206 includes one or more support decks, such as a first support deck 212 and a second support deck 214. Each support deck 212, 214 defines a corresponding planar top surface 216 over which backsplash 202 can be mounted. Furthermore, a corresponding bottom surface 218 is provided on each support deck 212, 214, beneath planar top surface 216, e.g., opposite top surface 216 along the vertical direction V. As shown, second support deck 214 includes a separate left support portion 220 and right support portion 222. Each of the support portions 220, 222 are spaced laterally, i.e., in the lateral direction L. First support deck 212 extends in the lateral direction L between left support portion 220 and right support portion 222. When assembled, planar top surface 216 of second support deck 214 is disposed beneath the planar top surface 216 of the first support deck 212 relative to the vertical direction V, i.e., at a lower position in the vertical direction V.

Each support deck 212, 214 also defines one or more apertures 224, 226 extending in the vertical direction V through the backsplash bracket 206. Optionally, first support deck 212 defines a plurality of first apertures 224 extending from planar top surface 216 to bottom surface 218. As shown, each first aperture 224 may be aligned relative to the transverse direction T and spaced apart from one another along the lateral direction L. Second support deck 214 defines a plurality of second apertures 226 extending from planar top surface 216 to bottom surface 218. One or more second apertures 226 are spaced apart from one another along the lateral direction L. At least one second aperture 226 is included on each of right support portion 222 and left support portion 220. In optional embodiments, one or more mechanical connectors, e.g., screw, bolt, clip, brace, etc., may be connected to or through backsplash 202 to selectively fix backsplash 202 on top cover 204, e.g., in the transverse direction T. For instance, mated holes 227 may be defined through the backsplash 202 and backsplash bracket 206 to receive a rigid screw or bolt therethrough, and thereby fix backsplash 202 to backsplash bracket 206 such that backsplash 202 is not movable along the transverse direction.

In some embodiments, backsplash bracket 206 is integrally formed on top cover 204. Specifically, backsplash bracket 206, including each of first support deck 212 and second support deck 214, is formed at rear portion 210 of top cover 204, e.g., as a unitary member constructed of or with a single continuous piece of material, such as a plastic and/or metal. In particular, stamped metal or molded plastic.

As shown, backsplash 202 includes a perimeter rim 228 defined along the bottom of backsplash 202. Perimeter rim 228 defines, e.g., an outermost extreme of backsplash 202, and determines the area over top cover 204 that backsplash 202 will cover. Perimeter rim 228 is configured as complementary to predefined footprint 208. When assembled, a portion of perimeter rim 228 may directly engage backsplash bracket 206 and rest thereon. In turn, when assembled, perimeter rim 228 is disposed above backsplash bracket 206, e.g., in the vertical direction V, at the surfaces of backsplash bracket 206 that perimeter rim 228 engages.

In some embodiments, an outer surface 230 of backsplash 202 is assembled to be flush with a visible outer surface 232 of top cover 204. Perimeter rim 228 contacts top cover 204 at outer surface 232 and forms a smooth engagement seam 234. Thus, the outer surface 230 of backsplash 202 is substantially continuous with outer surface 232 of top cover 204, except for the interruption at the engagement seam 234. Perimeter rim 228 includes a pair of perimeter edges 236 formed on opposite lateral ends of backsplash 202. When assembled, each perimeter edge 236 extends along the transverse direction T in slidable engagement with planar top surface 216. During assembly or disassembly, each perimeter edge 236 may slide along planar top surface 216 of second support deck 214.

Optionally, top cover 204 includes an integrally-formed elevated lip 238. Elevated lip 238 is positioned adjacent to backsplash bracket 206 and extends laterally across at least a portion of backsplash bracket 206, e.g., at second support deck 214. Moreover, elevated lip 238 extends vertically from second support deck 214, above first support deck 212 and second support deck 214 in the vertical direction V. Advantageously, during assembly, backsplash 202 may be forced toward elevated lip 238 such that perimeter rim 228 directly engages elevated lip 238 and is restricted, e.g., in the transverse direction T, from further movement. In some such embodiments, perimeter rim 228 is substantially flush with elevated lip 238 when bracket assembly 200 is assembled.

Figure 6:
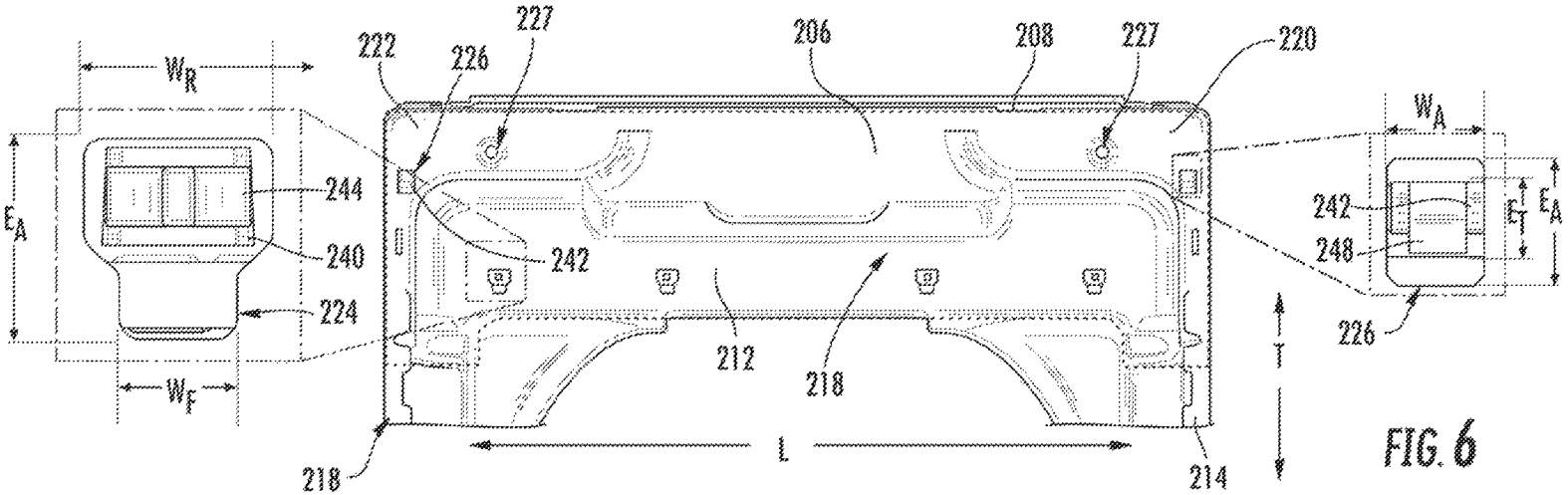
FIG. 6 provides a partially assembled bottom view of the exemplary backsplash assembly of FIG. 2.
Figure 7:
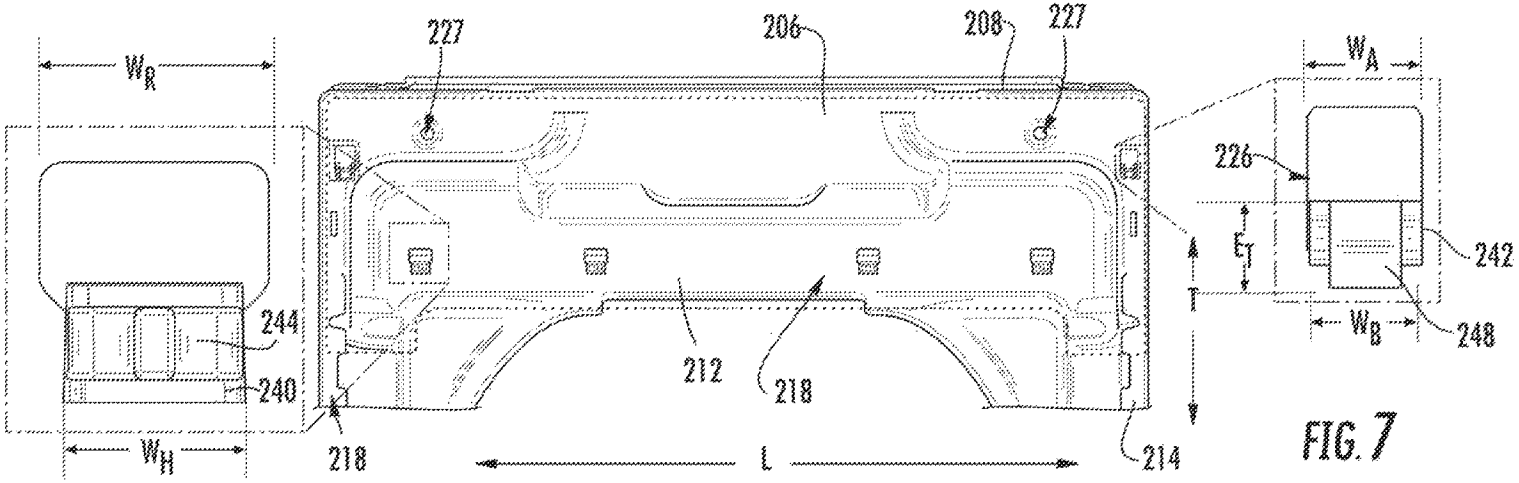
FIG. 7 provides a bottom view of the exemplary backsplash assembly of FIG. 2.
Figure 8:
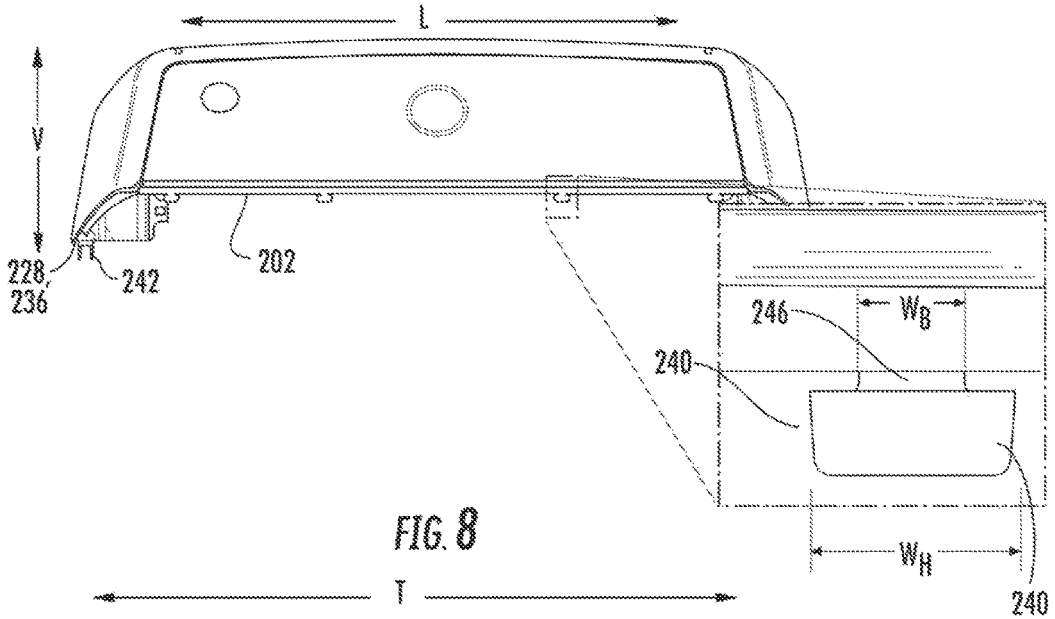
FIG. 8 provides a front view of the exemplary backsplash of FIG. 2.

As shown in FIGS. 6, 7, and 8, backsplash 202 includes a plurality of engagement hooks 240, 242. Specifically, backsplash 202 includes at least a first engagement hook 240 and a second engagement hook 242 that both extend downward in the vertical direction V. First engagement hook 240 is configured as a T-shaped prong disposed through first aperture 224. A prong body 246 extends through a corresponding first aperture 224. A side tab 244 of the T-shaped prong extends in the lateral direction L from prong body 246. As a result, side tab 244 defines a hook width $W_H$ in the lateral direction L that is greater than the width $W_B$ of the prong body 246.

In embodiments wherein a plurality of first engagement hooks 240 are provided, each first engagement hook 240 may be spaced in the lateral direction L from each other. Each spaced first engagement hook 240 may be sized or configured as identical to the other first engagement hooks 240, as illustrated in FIG. 8. Alternatively, one or more first engagement hooks 240 may have a size or shape configuration that is unique from others of the plurality of first engagement hooks 240. In such embodiments, each first engagement hook 240 is nonetheless matched to a corresponding first aperture 224.

Figure 9:
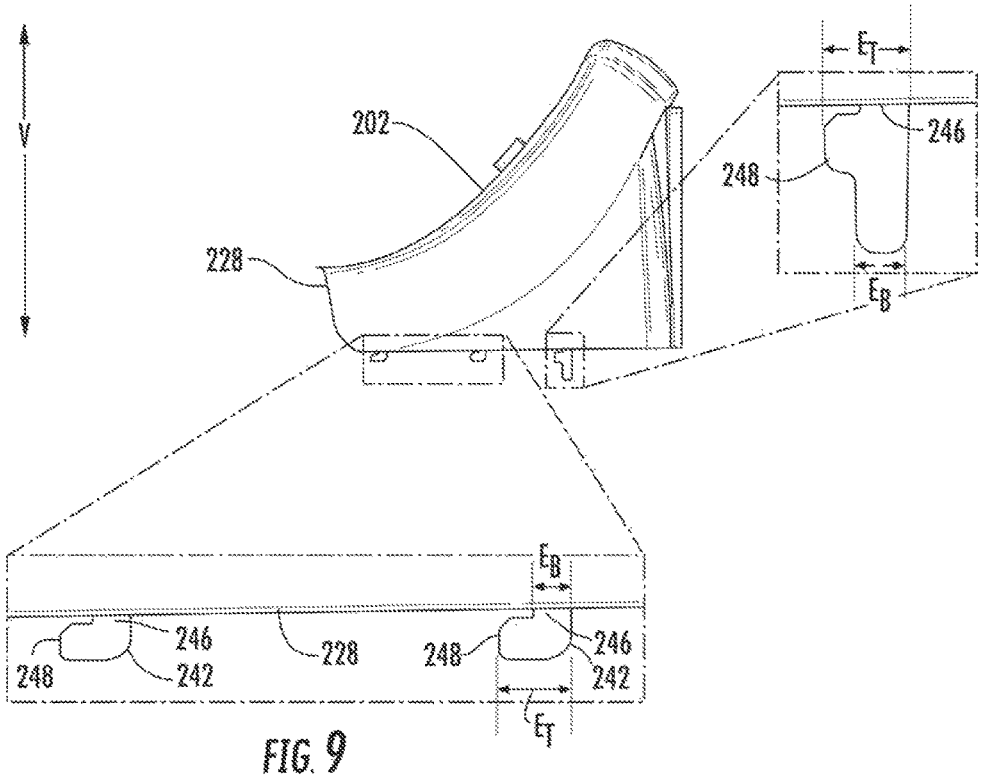
FIG. 9 provides a side view of the exemplary backsplash of FIG. 2.

As shown in FIGS. 6, 7, and 9, second engagement hook 242 is configured as an L-shaped prong disposed through second aperture 226. A prong body 246 of second engagement hook 242 extends through a corresponding second aperture 226. A forward tab 248 of the L-shaped prong extends in the transverse direction T from prong body 246. Moreover, the forward tab 248 defines a tab length $E_T$ that is greater than the length $E_B$ of the prong body 246. In embodiments wherein a plurality of second engagement hooks 242 are provided, multiple second engagement hooks 242 may be spaced in the transverse direction T from each other, e.g., on the same support portion 220, 222. Each second engagement hook 242 may be sized or configured as identical to each other second engagement hook 242. Alternatively, one or more second engagement hooks 242 may have a size or shape configuration, e.g., $E_T$ and/or $E_B$, that is unique from others of the plurality of second engagement hooks 242, as illustrated in FIG. 9. In such embodiments, each second engagement hook 242 is matched to a corresponding second aperture 226.

As illustrated, e.g., in FIGS. 6 and 7, first and second engagement hooks 240, 242 are matched to first and second apertures 224, 226 respectfully. For instance, each first aperture 224 defines a rear aperture width $W_R$ and a front aperture width $W_F$. Although width of first aperture 224 varies in the lateral direction L, first aperture 224 extends unobstructed in the transverse direction T to define an aperture length $E_A$. Although the rear aperture width $W_R$ and front aperture width $W_F$ are generally aligned, the rear aperture width $W_R$ is greater that the front aperture width $W_F$ such that the front aperture width $W_F$ is defined within the lateral span of the rear aperture width $W_R$. Moreover, the rear aperture width $W_R$ is generally greater than the hook width $W_H$. The front aperture width $W_F$ is less than the hook width $W_H$, but larger than the width $W_B$ of the prong body 246. When assembled, first engagement hook 240 is disposed in slidable engagement across the bottom surface 218 of first support deck 212. Side tab 244 extends along the lateral direction L across the bottom surface 218 of the first support deck 212. Although side tab 244 may pass through first aperture 224 at rear aperture width $W_R$, front aperture width $W_F$ will restrict movement of first engagement hook 240 in the vertical direction V. In turn, prong body 246 will restrict movement of first engagement hook 240 in the lateral direction L.

Each second aperture 226 defines an aperture length $E_A$ in the transverse direction T. A constant aperture width $W_A$ may be defined in the lateral direction L. The aperture length $E_A$ of the second aperture 226 is greater than a length of the second engagement hook 242, specifically, the tab length $E_T$ of the forward tab 248. Similarly, the aperture width $W_A$ of second aperture 226 is greater than the width $W_B$ of the prong body 246 of the second engagement hook 242. When assembled, second engagement hook 242 is disposed through second aperture 226. Forward tab 248 is disposed in slidable engagement with the bottom surface 218 of second support deck 214. Although forward tab 248 may pass through first aperture 224 at rear portion of second aperture 226, forward tab 248 will be restricted from movement in the vertical direction V when disposed at a forward portion of second aperture 226 due to engagement between the bottom surface 218 of second support deck 214 and second engagement hook 242 prevents forward tab 248 from moving above bottom surface 218 in the vertical direction V. Prong body 246 will restrict movement of second engagement hook 242 in the lateral direction L.

Figure 4:
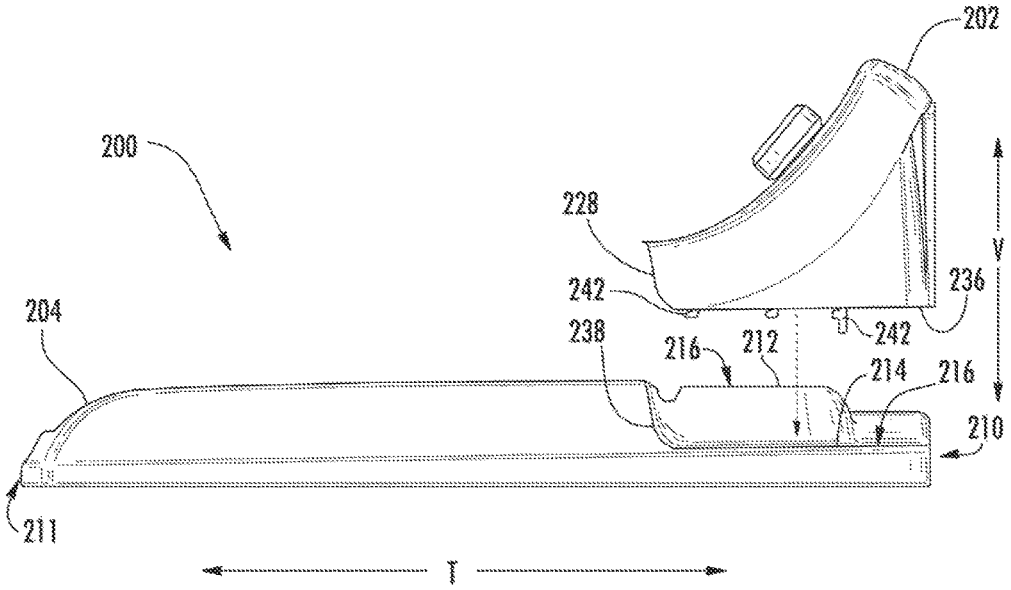
FIG. 4 provides an exploded side view of the exemplary backsplash assembly of FIG. 2.
Figure 5:
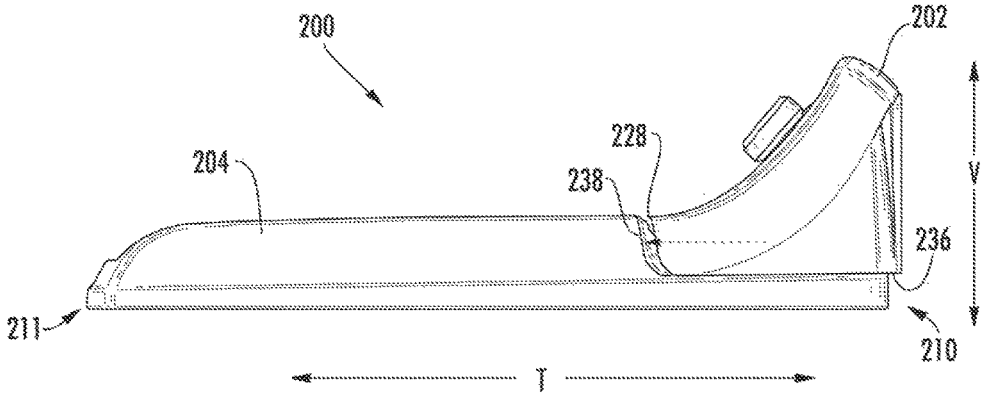
FIG. 5 provides a partially assembled side view of the exemplary backsplash assembly of FIG. 2.

Positioning of backsplash 202 on backsplash bracket 206 may include two discrete orthogonal motions, free of any rotation. Specifically, positioning includes a primarily vertical motion (See FIG. 4) and a primarily transverse motion (See FIG. 5). As illustrated in FIG. 4, backsplash 202 may be directed in the vertical direction V to bring backsplash 202 into contact with a portion of backsplash bracket 206. Each of first engagement hook 240 and second engagement hook 242 pass through first aperture 224 and second aperture 226, respectively (See FIG. 6). Once first engagement hook 240 and second engagement hook 242 pass through first and second apertures 224, 226, backsplash 202 may be moved forward in the transverse direction T, as illustrated in FIGS. 5 and 7. The transverse motion may be halted by contact or engagement between elevated lip 238 and perimeter rim 228 (See FIG. 3). Generally, the forward transverse motion brings engagement hooks 240, 242 directly beneath bottom surface 218, such that vertical movement is restricted.

Although a vertical motion and transverse motion are described for positioning backsplash 202 on backsplash bracket 206, it is understood that similar but opposite motions could be used to remove backsplash 202 from backsplash bracket 206. For example, during disassembly, backsplash 202 may be directed rearward in a transverse motion, then moved upward in a vertical motion to bring first and second engagement hooks 240, 242 out of first and second apertures 224, 226.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine defining a lateral direction, a transverse direction, and a vertical direction that are mutually orthogonal, the washing machine comprising:

a cabinet defining an opening and including a backsplash bracket having a predefined footprint, the backsplash bracket including a first support deck and a second support deck, the first support deck having a planar top surface defining a rear portion of the opening, the second support deck also having a planar top surface, the planar top surface of the second support deck positioned beneath the planar top surface of the first support deck along the vertical direction;

a basket mounted within the cabinet, the basket defining a wash chamber beneath the opening to receive one or more clothing articles to be washed; and a backsplash positioned over the predefined footprint, the backsplash including a first engagement hook disposed on the first support deck and a second engagement hook disposed on the second support deck such that the first and second engagement hooks mount the backsplash to the backsplash bracket, wherein the second support deck includes a left support portion and a right support portion, and wherein the first support deck extends in the lateral direction from the left support portion to the right support portion such that the first support deck separates the left support portion from the right support portion along the lateral direction.

2. The washing machine of claim 1, wherein the first support deck defines a first aperture extending in the vertical direction through the first support deck, wherein the second support deck defines a second aperture extending in the vertical direction through the second support deck, wherein the first engagement hook includes a prong extending through the first aperture and across a portion of a bottom surface of the first support deck, and wherein the second engagement hook includes a prong extending through the second aperture and across a portion of a bottom surface of the second support deck.

3. The washing machine of claim 2, wherein the prong of the first engagement hook includes a side tab extending along the lateral direction across the bottom surface of the first support deck.

4. The washing machine of claim 3, wherein the first aperture includes a plurality of discrete first apertures spaced apart from one another along the lateral direction, and wherein the first engagement hook includes a plurality of first engagement hooks, each engagement hook of the plurality of first engagement hooks being matched to a respective one of the plurality of discrete first apertures.

5. The washing machine of claim 3, wherein the side tab defines a hook width in the lateral direction, and wherein the first aperture defines a rear aperture width and a front aperture width, the rear aperture width being greater than the hook width and the front aperture width being less than the hook width.

6. The washing machine of claim 2, wherein the prong of the second engagement hook includes a forward tab extending along the transverse direction across the bottom surface of the second support deck.

7. The washing machine of claim 6, wherein the second aperture includes a plurality of discrete second apertures spaced apart from one another along the lateral direction, and wherein the second engagement hook includes a plurality of second engagement hooks, each engagement hook of the plurality of second engagement hooks being matched to a respective one of the plurality of discrete second apertures.

8. The washing machine of claim 6, wherein the forward tab defines a tab length in the transverse direction, and wherein the second aperture defines an aperture length greater than the tab length.

9. The washing machine of claim 1, wherein the backsplash includes a perimeter rim complementary to the predefined footprint of the backsplash bracket, and wherein the cabinet includes an elevated lip positioned adjacent the backsplash bracket and extending from at least one of the first support deck or the second support deck, an outer surface of backsplash at the perimeter rim being flush with an outer surface of the cabinet at the elevated lip.

10. The washing machine of claim 9, wherein the perimeter rim includes a pair of perimeter edges formed on opposite lateral ends of the backsplash, wherein each perimeter edge extends along the transverse direction in slidable engagement with the planar top surface of the second support deck.

11. The washing machine of claim 1, wherein the backsplash includes an input selector to control operation of the washing machine appliance.

12. The washing machine of claim 1, wherein the cabinet includes a plurality of sidewalls supporting a top cover, wherein the opening is defined through the top cover, and wherein the backsplash bracket is integrally formed on the top cover at a rear portion of the top cover.

13. A washing machine defining a lateral direction, a transverse direction, and a vertical direction that are mutually orthogonal, the washing machine comprising:

a cabinet defining an opening and including a backsplash bracket having a predefined footprint, the backsplash bracket including one or more support decks, the one or more support decks including a first support deck and a second support deck, each support deck having a planar top surface and a bottom surface, the backsplash bracket defining a first aperture extending through one of the one or more support decks between a corresponding planar top surface and a corresponding bottom surface, and a second aperture extending through one of the one or more support decks between a corresponding planar top surface and a corresponding bottom surface;

a basket mounted within the cabinet, the basket defining a wash chamber beneath the opening to receive one or more clothing articles to be washed; and a backsplash positioned over the predefined footprint, the backsplash including a first engagement hook and a second engagement hook, the first engagement hook being disposed in slidable engagement across the corresponding bottom surface of the first aperture, and the second engagement hook being disposed in slidable engagement across the corresponding bottom surface of the second aperture such that the first and second engagement hooks mount the backsplash to the backsplash bracket, wherein the second support deck includes a left support portion and a right support portion, wherein the first support deck extends in the lateral direction from the left support portion to the right support portion such that the first support deck separates the left support portion from the right support portion along the lateral direction, and wherein the first support deck defines a rear portion of the opening.

14. The washing machine of claim 13, wherein the first engagement hook includes a prong extending through the first aperture, the prong including a side tab extending along the lateral direction across the corresponding bottom surface of the first aperture.

15. The washing machine of claim 14, wherein the first aperture includes a plurality of discrete first apertures spaced apart from one another along the lateral direction, and wherein the first engagement hook includes a plurality of first engagement hooks, each engagement hook of the plurality of first engagement hooks being matched to a respective one of the plurality of discrete first apertures.

16. The washing machine of claim 14, wherein the side tab defines a hook width in the lateral direction, and wherein the first aperture defines a rear aperture width and a front aperture width, the rear aperture width being greater than the hook width and the front aperture width being less than the hook width.

17. The washing machine of claim 13, wherein the second engagement hook includes a prong extending through the second aperture, the prong including a forward tab extending along the transverse direction across the corresponding bottom surface of the first aperture.

18. The washing machine of claim 17, wherein the second aperture includes a plurality of discrete second apertures separated apart from one another along the transverse direction, and wherein the second engagement hook includes a plurality of second engagement hooks, each engagement hook of the plurality of second engagement hooks being matched to a respective one of the plurality of discrete second apertures.

19. The washing machine of claim 17, wherein the forward tab defines a tab length in the transverse direction, and wherein the second aperture defines an aperture length greater than the tab length of the second engagement hook.

* * * * *